US007077674B2

(12) United States Patent
Hirata

(10) Patent No.: US 7,077,674 B2
(45) Date of Patent: Jul. 18, 2006

(54) BOARD ATTACHMENT TYPE ELECTRICAL CONNECTOR

(75) Inventor: Yoshikazu Hirata, Kanagawa (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/139,958

(22) Filed: May 27, 2005

(65) Prior Publication Data

US 2005/0266722 A1 Dec. 1, 2005

(30) Foreign Application Priority Data

May 27, 2004 (JP) ..... 2004-158234

(51) Int. Cl.
*H01R 13/04* (2006.01)

(52) U.S. Cl. ..... 439/246

(58) Field of Classification Search ..... 439/246, 439/247, 248, 79, 74, 76, 474, 249–252
See application file for complete search history.

(56) References Cited

U.S. PATENT DOCUMENTS 4,722,691 A * 2/1988 Gladd et al. ..... 439/79
5,122,066 A * 6/1992 Plossmer ..... 439/78
5,306,168 A * 4/1994 Kunishi et al. ..... 439/248
5,306,169 A * 4/1994 Fukushima et al. ..... 439/248
6,039,590 A 3/2000 Kunishi et al.
6,095,827 A * 8/2000 Dutkowsky et al. ..... 439/83
6,755,691 B1 * 6/2004 Sasame et al. ..... 439/607
6,814,598 B1 * 11/2004 Hoffmann et al. ..... 439/249
6,939,154 B1 * 9/2005 Horikoshi et al. ..... 439/247

FOREIGN PATENT DOCUMENTS

EP 0579 053 A 1/1994
JP 04-344544 12/1992
JP 2000-235878 8/2000
JP 2002-134196 5/2002

OTHER PUBLICATIONS

Anonymous: "Compliant Gauge Connector" Research Disclosure, Kenneth Mason Publication, Westbourne, GB, vol. 381, No. 47, Jan. 1, 1996, (XP007120831).

* cited by examiner

*Primary Examiner*—Alexander D. Gilman
(74) *Attorney, Agent, or Firm*—Barley Snyder LLC

(57) ABSTRACT

A board attachment type electrical connector is provided which can absorb an impact in the direction perpendicular to the contact parts, and through which a relatively large current can flow. Each of the flexible connecting parts in the board attachment type electrical connector has a first extension part that extends in a direction substantially parallel to the contact part after being bent from one side edge of the contact part (base plate part), and a second extension part that extends in the opposite direction from the first extension part substantially parallel to the contact part after being bent from the other side edge of the contact part. At least one of the first extension part and second extension part is connected to the board connecting part.

5 Claims, 12 Drawing Sheets

BOARD ATTACHMENT TYPE ELECTRICAL CONNECTOR

FIELD OF THE INVENTION

The present invention relates to an electrical connector for attachment to a circuit board that is constructed to provide free play of contacts that mate to a connector with respect to connecting parts that are connected to a circuit board.

BACKGROUND OF THE INVENTION

In general, a battery connector (i.e., a connector contained in a battery pack) that is built in a portable telephone is designed to make mating connection with a board attachment type electrical connector (hereafter referred to simply as "electrical connector") that is mounted on a circuit board on the side of the main body of the portable telephone.

The electrical connector 101 shown in FIG. 11 (see JP2000-235878A), for example, has been conventionally known as an electrical connector of the board attachment type.

This electrical connector 101 comprises a housing 110 that is mounted on a circuit board PCB and a plurality of contacts 120 that are attached to this housing 110. Furthermore, each of the contacts 120 comprises a substantially rectangular base plate part 121, a press-fitting fastening part 122 that extends upward from the base plate part 121 and that is press-fitted to the housing 110, and a contact part 123 that extends forward from the upper portion of the front end (right end in FIG. 11) of the base plate part 121. Each contact part 123 is formed with a flat plate-shaped tab, and protrudes further to the front than the front-end surface of the housing 110 so that both main surfaces are perpendicular to the direction in which the contacts 120 are aligned (direction perpendicular to the plane of the page in FIG. 11). Moreover, a board connecting part 124 that is connected by soldering to the circuit board PCB extends downward from the lower portion of the rear end of each base plate part 121.

Furthermore, the electrical connector 101 mates with a mating battery connector 130. As a result, the contact parts 123 of the contacts 120 are accommodated by the mating contacts 131 of the mating battery connector 130, and make contact therewith, thus electrically connecting the circuit board PCB and the battery.

Moreover, the electrical connector shown in FIG. 12 (see JP2002-134196A), for example, has also been known as another electrical connector that makes mating connection with a mating battery connector.

This electrical connector 201 comprises a housing 210 that is mounted on a circuit board (not shown in the figure) and a plurality of contacts 220 that are attached to this housing 210. Furthermore, each of the contacts 220 comprises a press-fitting fastening part 221 that is press-fitted to the housing 210, a contact part 222 that extends upward from the press-fitting fastening part 221 and that makes contact with a corresponding mating contact (not shown in the figure), and a board connecting part 223 that extends downward from the press-fitting fastening part 221 and that is connected by soldering to the circuit board (not shown in the figure). Each contact part 222 is formed with a flat plate-shaped tab, and protrudes further upward than the upper-end surface of the housing 210 so that both main surfaces are perpendicular to the direction of alignment of the contacts 220 (left-right direction in FIG. 12). The electrical connector 201 mates with a mating battery connector (not shown in the figure). As a result, the contact parts 222 of the contacts 220 are accommodated by the mating contacts of the mating battery connector, and make contact therewith, so that the circuit board and the battery are electrically connected.

However, with these electrical connectors 101 and 201, for instance, in cases where an impact is applied in a direction perpendicular to the main surfaces of the contact parts 123 and 222 by the dropping or the like of portable telephones that contain the electrical connectors 101 and 201, there is a danger that the housings 110 and 210 and contacts 120 and 220 will be damaged since the contact parts 123 and 222 are not movable.

In order to handle this problem, the electrical connector shown in FIG. 13 (see JP06-44063U), for example, has been known as an electrical connector in which contact parts are designed to be movable.

This electrical connector 301 comprises a first housing 310 that is mounted on a circuit board (not shown in the figure), a second housing 320 that is located on the upper surface of the first housing 310, and a plurality of contacts 330.

Here, each of the contacts 330 comprises a first press-fitting part 331 that is press-fitted into a press-fitted fastening passage 321 in the second housing 320, a contact part 332 that extends forward (toward the left in FIG. 13) from the first press-fitting part 331, a second press-fitting part 334 that is press-fitted into a press-fitted fastening hole 311 in the first housing 310, a flexible connecting part 333 that connects the first press-fitting part 331 and the second press-fitting part 334, and a board connecting part 335 that extends downward from the second press-fitting part 334. Each flexible connecting part 333 is formed into a structure that extends in the vertical direction and is bent forward and rearward; the lower portion of the flexible connecting part 333 is located inside a first cavity formed in the first housing, and the upper portion of the flexible connecting part 333 is located inside a second cavity 322 formed in the second housing 320. The first and second press fitting parts 331, 334 are in the form of a fastening plate.

Each contact part 332 is formed with a flat plate-shaped tab, and protrudes forward so that both main surfaces are perpendicular to the direction of alignment of the contacts 330 (direction perpendicular to the plane of the page in FIG. 13). Moreover, each contact part 332 protrudes downward from the lower surface of the first housing 310 and is connected by soldering to a circuit board (not shown in the figure). Furthermore, each of the contact parts 332 is constructed so that free play is possible with respect to the board connecting part 335 by means of the flexible connecting part 333 that connects the first press-fitting fastening plate part 331 and the second press-fitting part 334, thus allowing the movement in the rearward direction indicated by arrow X in FIG. 13, the movement in the forward direction indicated by arrow Y, the movement in the upward direction indicated by arrow Z, and the movement in the direction of alignment of the contacts 330.

Accordingly, in cases where an impact is applied in the direction perpendicular to the main surfaces of the contact parts 332 (i.e., in the direction of alignment of the contacts 330), since the contact parts 332 can move in this direction, it is possible to avoid the danger of damaging the first housing 310, second housing 320 or contacts 330.

However, the following problems have been encountered in the electrical connector 301 shown in FIG. 13:

Specifically, in order to increase the free play of the contact parts 332 with respect to the board connecting parts 335, it is necessary to increase the flexibility of the flexible connecting parts 333, and in order to increase the flexibility of these flexible connecting parts 333, it is necessary to increase the total length of these flexible connecting parts 333. However, since each of the flexible connecting parts 333 is formed into a structure that extends in the vertical direction and is bent forward and rearward in the same plane as the contact part 332, in order to increase the total length of the flexible connecting part 333, the width must be reduced, so that a large current (maximum of approximately 3 A) cannot be caused to flow. The width of the flexible connecting parts 333 of the electrical connector 301 shown in FIG. 13 is smaller than the width of the board connecting parts 335, so that a large current cannot be caused to flow.

SUMMARY

Accordingly, the present invention was devised in light of the problems described above; it is an object of the present invention to provide a board attachment type electrical connector which can absorb an impact in the direction perpendicular to the contact parts, and through which a relatively large current can be caused to flow.

In order to solve the problems described above, the board attachment type electrical connector of claim 1 is a board attachment type electrical connector comprising a first housing, a second housing that is located on this first housing, and a plurality of contacts, with each of these contacts having a contact part that is held by the second housing and that contacts a corresponding mating contact, a board connecting part that is held by the first housing and that is connected to a circuit board, and a flexible connecting part that allows the contact part to have free play with respect to the board connecting part, wherein the flexible connecting part has a first extension part that extends in a direction substantially parallel to the contact part after being bent from one side edge of the contact part, and a second extension part that extends in the opposite direction from the first extension part substantially parallel to the contact part after being bent from the other side edge of the contact part, and at least one of the first and second extension parts is connected to the board connecting part.

DETAILED DESCRIPTION OF THE EMBODIMENT(S)

Next, an embodiment of the present invention will be described with reference to the figures.

In FIGS. 1, 2A through 2C, and 3A through 3C, the board attachment type electrical connector (hereafter referred to simply as "electrical connector") 1 comprises a first housing 10, a second housing 20 that is located on the first housing 10, a plurality of contacts 30 (three contacts in the present embodiment), and a solder peg 40 made of metal.

Figure 4A:
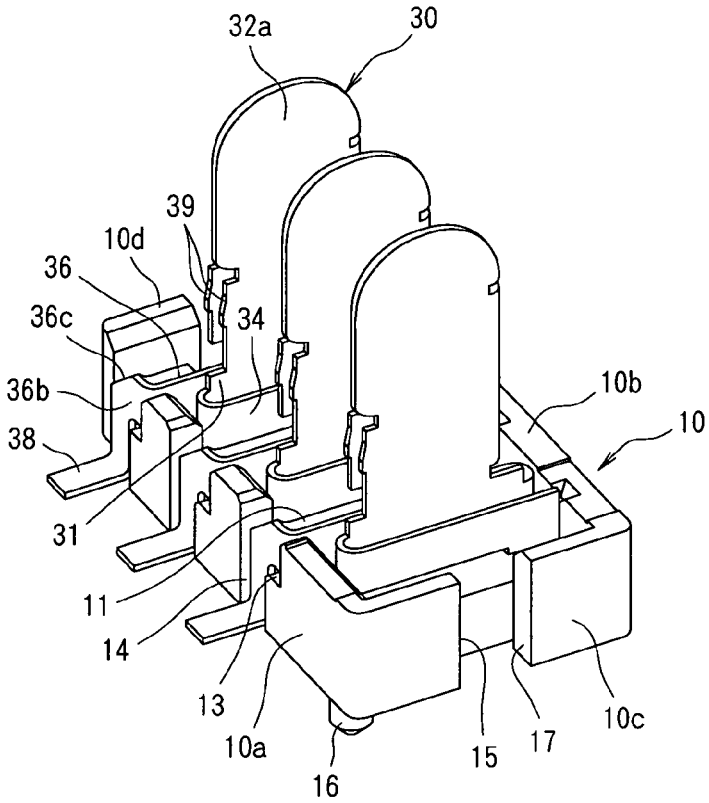
FIGS. 4A and 4B show the board attachment type electrical connector of FIG. 1 with the solder peg and second housing omitted, with FIG. 4A being a perspective view, and FIG. 4B being a plan view.
Figure 4B:
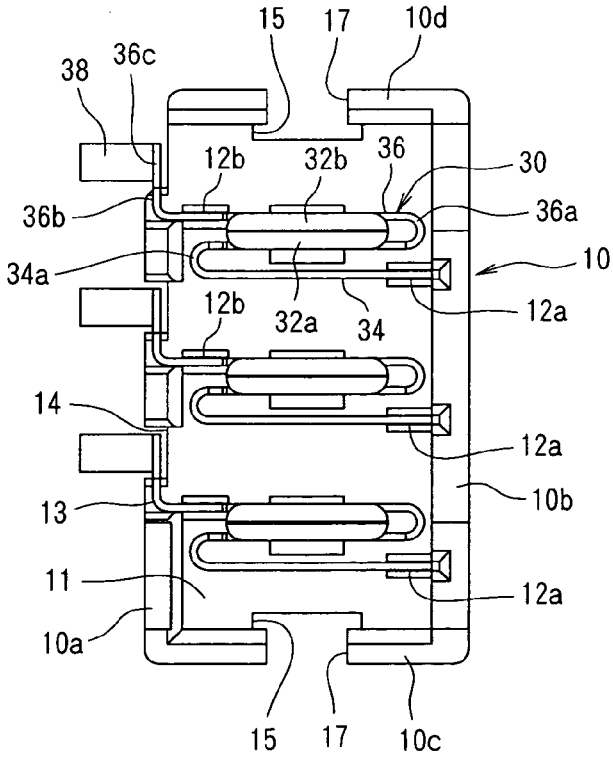
Figure 5:
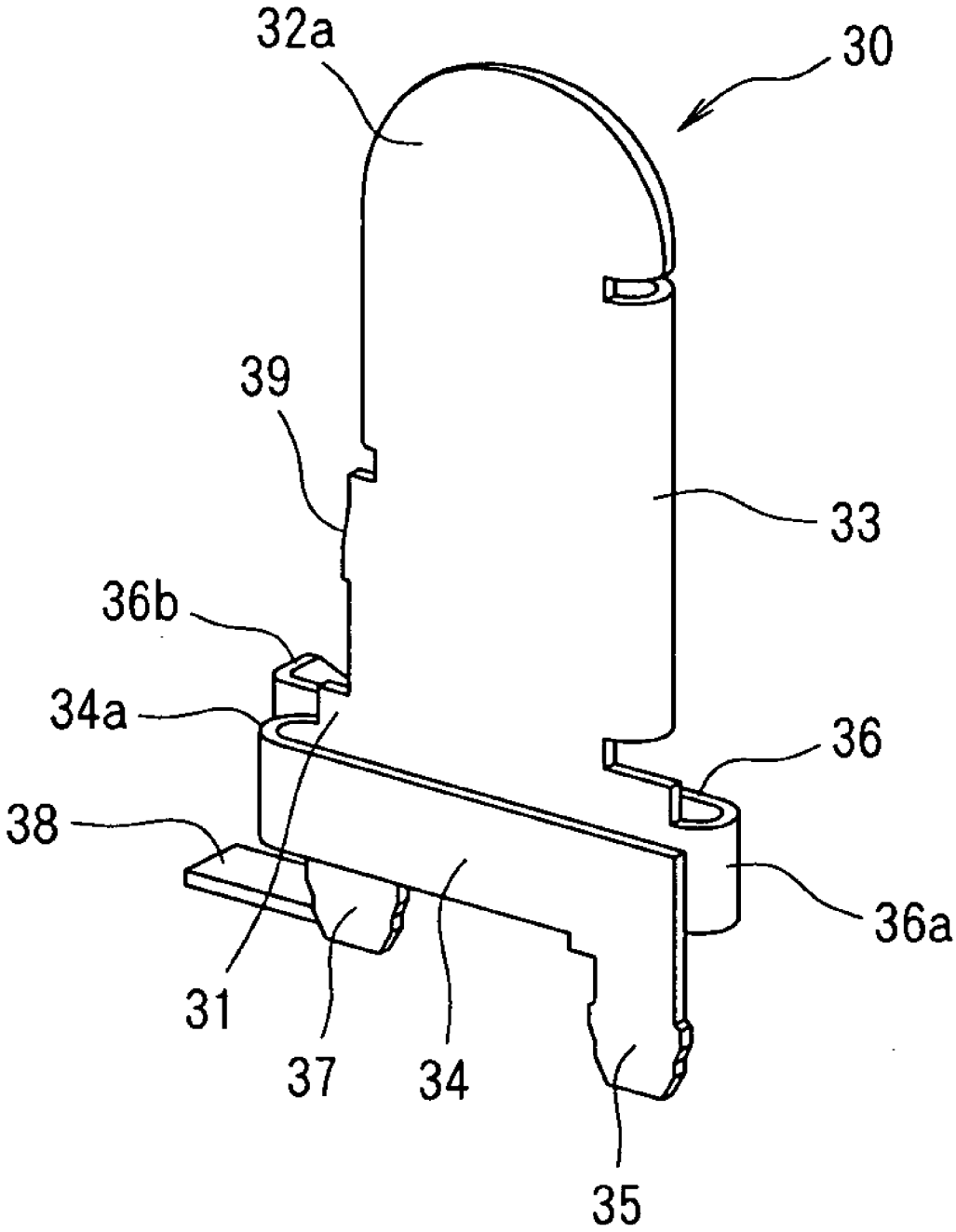
FIG. 5 is a perspective view of a contact for the board attachment type electrical connector of FIG. 1.
Figure 6A:
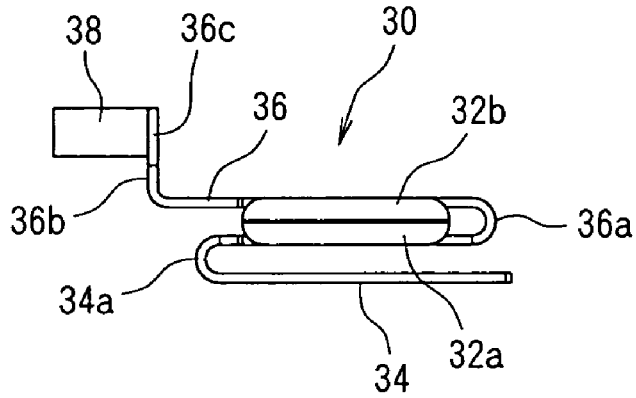
FIGS. 6A through 6C show the contact of FIG. 5, with FIG. 6A being a plan view, FIG. 6B being a front view, and FIG. 6C being a bottom view.
Figure 6B:
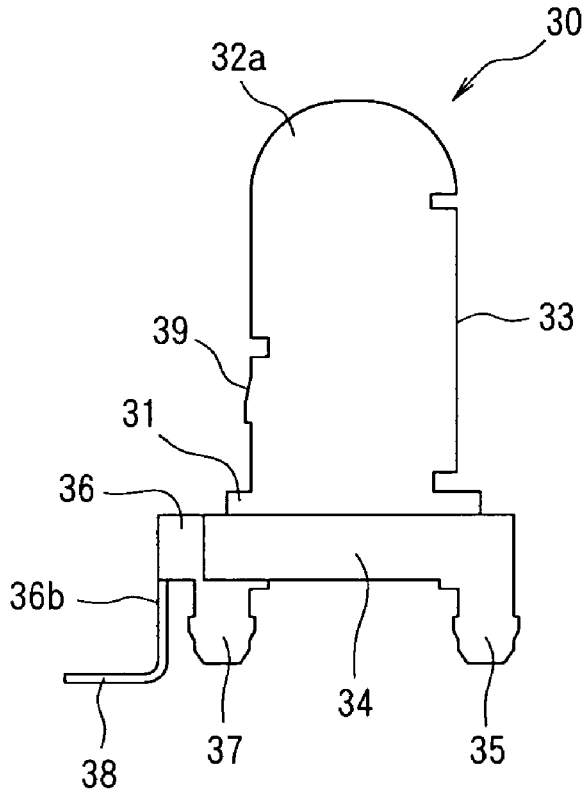
Figure 6C:
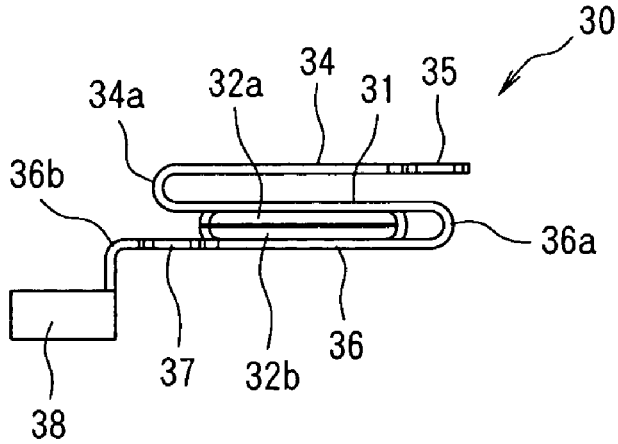

Here, as is clearly shown in FIGS. 4A and 4B, the first housing 10 is formed with a substantially rectangular shape that extends longitudinally in the forward-rearward direction (vertical direction in FIG. 4B), and a contact accommodating recessed part 11 that accommodates all of the plurality of contacts 30 at once is formed in the upper surface of this first housing. The first housing 10 may be formed by molding an insulating resin. A plurality of press-fitted holes 12*a* into which first press-fitting fastening parts (described later) 35 of the contacts 30 are press-fitted are formed in the bottom portion of the contact accommodating recessed part 11 at a specified pitch along the inside of the right-side wall 10*b*, and a plurality of press-fitted holes 12*b* into which second press-fitting fastening parts (described later) 37 of the contacts 30 are press-fitted are formed at a specified pitch along the inside of the left-side wall 10*a*. Furthermore, press-fitted fastening holes 15 into which a pair of leg parts (described later) 44 of the solder peg 40 are respectively press-fitted are formed in the bottom portion of the contact accommodating recessed part 11 on the inside of the front-end wall 10*c* and rear-end wall 10*d* of the first housing 10. Moreover, cutouts 17 used for the outward protrusion of the portions of the leg parts 44 that are respectively bent outward are formed in the front-end wall 10*c* and rear-end wall 10*d* of the first housing 10 in positions corresponding to the press-fitted fastening holes 15. In addition, a plurality of positioning posts 16 are formed to protrude from the undersurface of the first housing 10.

Furthermore, the second housing 20 is formed with a substantially rectangular shape that extends longitudinally in the forward-rearward direction, and comprises a base stand part 21 that is positioned above the left-side wall 10*a*, right-side wall 10*b*, front-end wall 10*c* and rear-end wall 10*d* of the first housing 10, and a protruding part 22 that protrudes upward from the upper surface of the base stand part 21. The second housing 20 may be formed by molding an insulating resin. As is shown clearly in FIG. 3C, the protruding part 22 is shaped to have a smaller width in the left-right direction than the base stand part 21, and shoulder parts 24 are formed on the left and right sides of the protruding part 22. A plurality of press-fitted locking passages 23 through which first and second contact plates 32*a* and 32*b* (described later) of the contacts 30 pass and with which barbs 39 (see FIG. 4A) are locked are formed in the second housing 20 at a specified pitch along the forward-rearward direction. The press-fitted locking passages 23 extend in the left-right direction, which is perpendicular to the forward-rearward direction. The second housing 20 is made movable over the first housing 10 in the forward-rearward direction and in the left-right direction until the movement is restricted by the solder peg 40.

Furthermore, the plurality of contacts 30 are arranged at a specified pitch in the forward-rearward direction with respect to the first and second housings 10 and 20. As is shown in FIGS. 5, 6A through 6C, and 7A through 7C, each of the contacts 30 comprises a rectangular base plate 31 that extends in the left-right direction (left-right direction in FIG. 5), a first contact plate 32*a* that extends upward from the base plate 31, and a second contact plate 32*b* that overlaps with the first contact plate 32*a* by extending leftward from the right-side edge of the first contact plate 32*a* via a folded bent part 33. Each contact 30 is formed by stamping and forming a conductive metal plate that has spring elasticity. The barbs 39 are formed to protrude from the respective left edges of the first contact plates 32*a* and second contact plates 32*b*. As is shown in FIGS. 1, 2A through 2C, and 3A through 3C, the first contact plates 32*a* and second contact plates 32*b* pass through the press-fitted locking passages 23 in the second housing 20 so that the respective tip end portions of these contact plates protrude upward from the upper surface of the second housing 20, and the barbs 39 are caused to lock with walls of the press-fitted locking passages 23 on one side. As a result, the base plates 31, first contact plates 32*a*, and second contact plates 32*b* are held by the second housing 20. In this case, the main surfaces of the first contact plates 32*a* and second contact plates 32*b* are perpendicular to the direction of alignment (forward-rearward direction) of the contacts 30. Moreover, the first contact plates 32*a* and second contact plates 32*b* are accommodated by mating contacts of a mating battery connector (not shown in the figures) as male type contacts, so that the respective outer main surfaces contact the mating contacts. Each of the base plates 31, first and second contact plates 32*a* and 32*b*, and folded bent part 33 constitute the "contact part" referred to in claim 1.

Figure 7A:
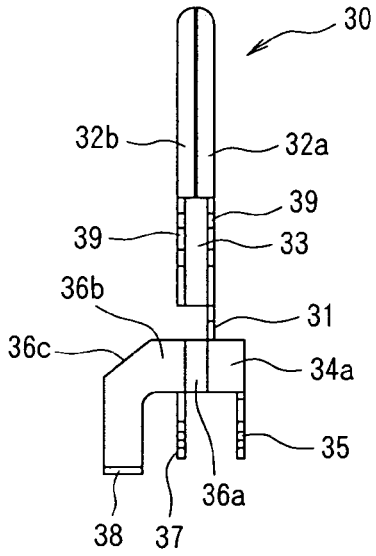
FIGS. 7A through 7C show the contact of FIG. 5, with FIG. 7A being a left-side view, FIG. 7B being a right-side view, and FIG. 7C being a back view.
Figure 7B:
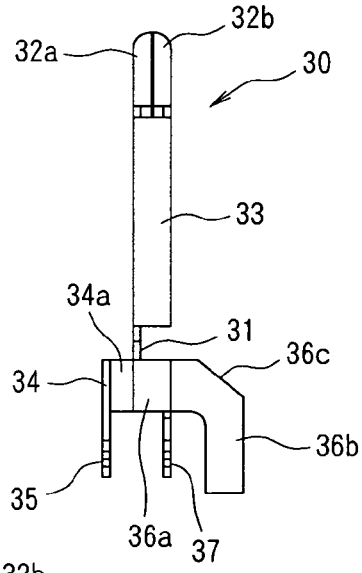
Figure 7C:
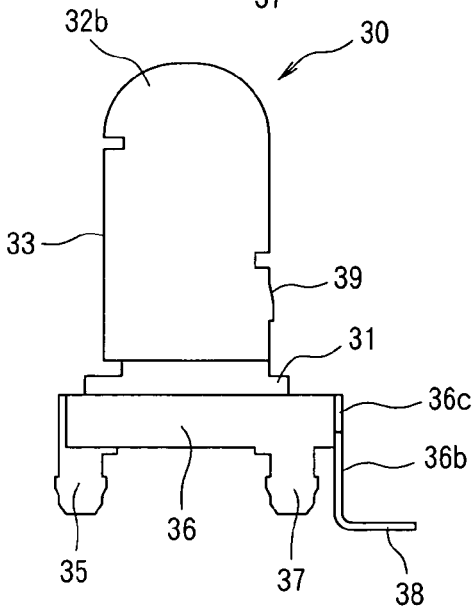

Each of the contacts 30 is provided with a first extension part 34 that extends rightward from the left-side edge of the base plate 31 substantially parallel to the base plate 31 via a folded bent part 34*a*, and a second extension part 36 that extends leftward (opposite direction from the first extension part) from the right-side edge of the base plate 31 substantially parallel to the base plate 31 via a folded bent part 36*a*. The respective first extension parts 34 extend until these first extension parts 34 reach further to the right than the right-side edges of the first and second contact plates 32*a* and 32*b*, and a first press-fitting part 35 is formed on the right end of each first extension part 34 so as to protrude downward. Meanwhile, the respective second extension parts 36 extend until these second extension parts 36 reach further to the left than the left-side edges of the first and second contact plates 32*a* and 32*b*, and a second press-fitting part 37 is formed to protrude downward in the vicinity of the left end of each second extension part 36. Moreover, a connecting part 36*b* that extends downward after being bent rearward (upward in FIG. 6A) is provided on the left end of each second extension part 36, and a board connecting part 38 is provided on the lower end of the connecting part 36*b* by bending this lower end leftward. The board connecting parts 38 are surface-mounted on and connected by soldering to a circuit board (not shown in the figures). As is shown in FIGS. 7A and 7B, an inclined surface 36*c* is formed on the corner portion of each connecting part 36*b*. The width of the first extension parts 34 and second extension parts 36 in the vertical direction is greater than the width of the board connecting parts 38 in the forward-rearward direction.

The first press-fitting parts 35 provided for the first extension parts 34 are respectively press-fitted from above into the press-fitted holes 12*a* formed in the first housing 10, and the second press-fitting parts 37 provided for the second extension parts 36 are respectively press-fitted from above into the press-fitted holes 12*b* formed in the first housing 10. At this point, the base plates 31, folded bent parts 34*a*, first extension parts 34, folded bent parts 36*a*, and second extension parts 36 are located on the bottom surface of the contact accommodating recess 11. Furthermore, the respective bent portions of the connecting parts 36*b* that extend rearward are positioned above the cutouts 13 that are formed in the left-side wall 10*a* of the first housing 10, and the portions of the connecting parts 36*b* that extend downward are positioned in other cutouts 14 that are formed in continuity with these cutouts 13. The board connecting parts 38 protrude leftward from the first housing 10 in a state in which the bottom surface of the first housing 10 and the undersurfaces of the board connecting parts 38 are coplanar. The board connecting parts 38 are held by the first housing 10 as a result of the press-fitting of the second press-fitting parts 37 that are linked with the board connecting parts 38 into the press-fitted holes 12*b* in the first housing 10. Moreover, as a result of the press-fitting of the first press-fitting parts 35 provided for the first extension parts 34 into the press-fitted holes 12*a*, and as a result of the second press-fitting parts 37 provided for the second extension parts 36 into the press-fitted holes 12*b*, the respective base plates 31 between the first extension parts 34 and second extension parts 36 can move with respect to the board connecting parts 38 that are held by the first housing 10 in the direction of alignment of the contacts 30, which is perpendicular to the main surfaces of the base plates 31, by means of the elasticity of both of the folded bent parts 34*a* and 36*a*, and of the first extension parts 34 and second extension parts 36. Accordingly, the contact parts constructed from the base plates 31, first and second contact plates 32*a* and 32*b*, and folded bent parts 33 can have free play with respect to the board connecting parts 38. Here, the "flexible connecting part" referred to in claim 1 is constructed from both folded bent parts 34*a* and 36*a*, a first extension part 34 and a second extension part 36.

Figure 1:
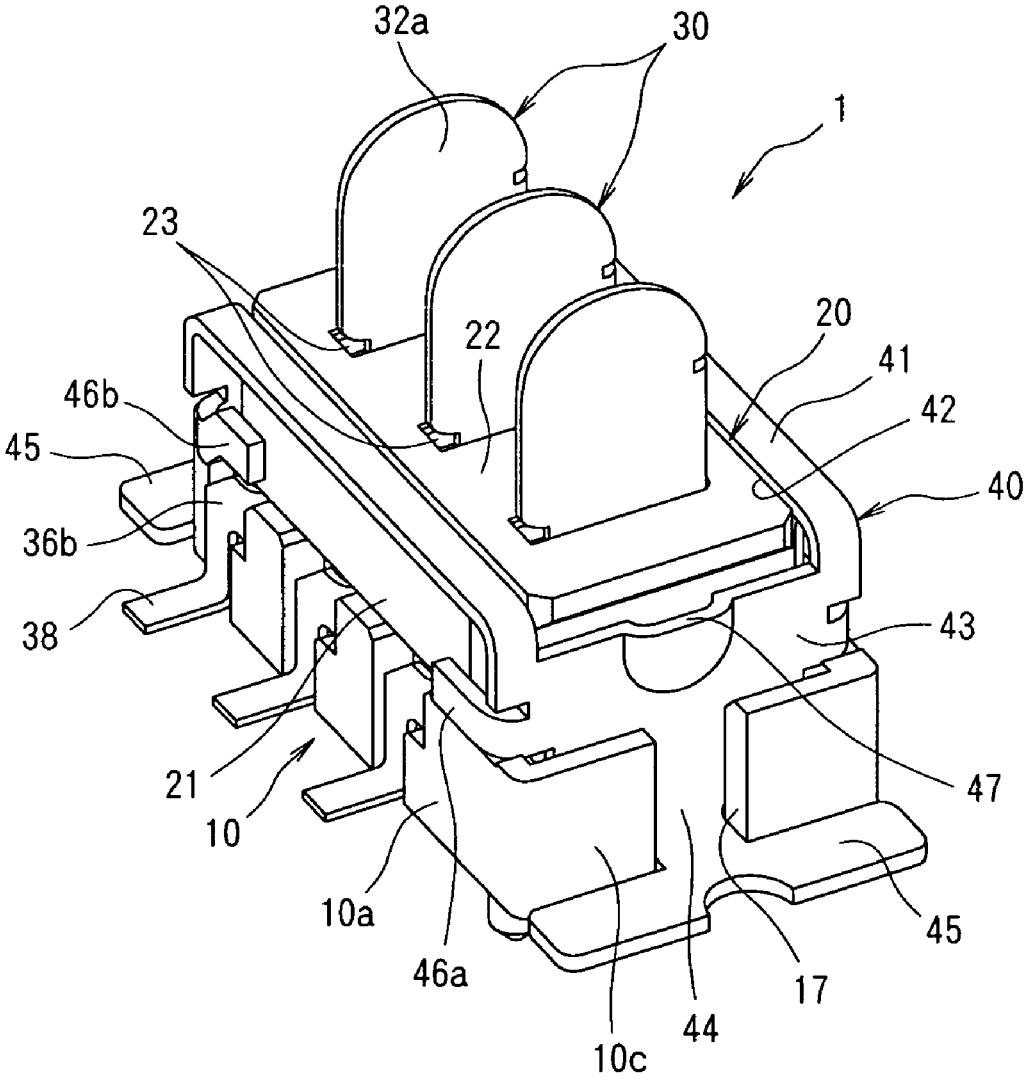
FIG. 1 is a perspective view of a board attachment type electrical connector according to an exemplary embodiment of the present invention.
Figure 2C:
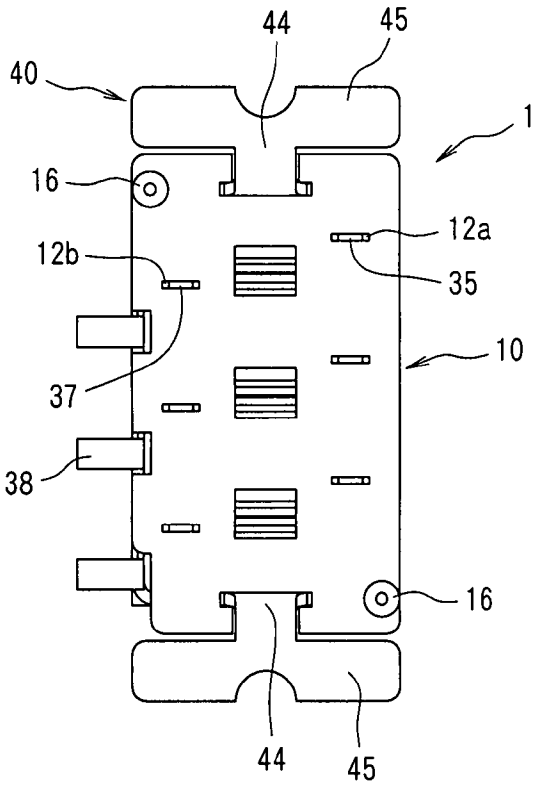
FIGS. 2A through 2C show the board attachment type electrical connector of FIG. 1, with FIG. 2A being a plan view, FIG. 2B being a front view, and FIG. 2C being a bottom view.
Figure 2B:
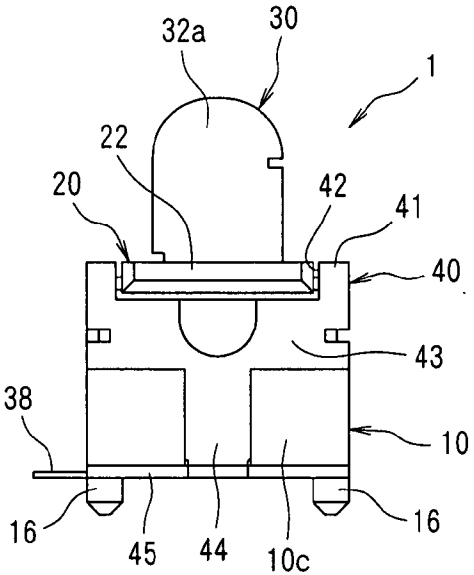
Figure 2A:
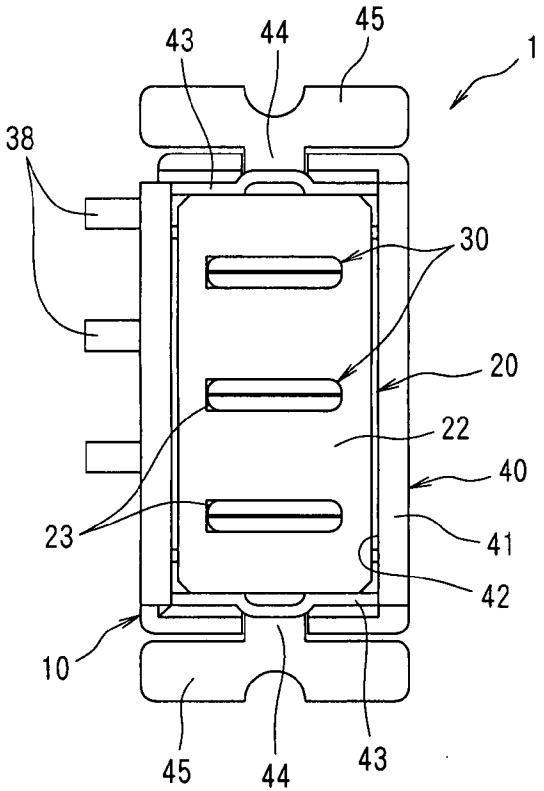
Figure 3A:
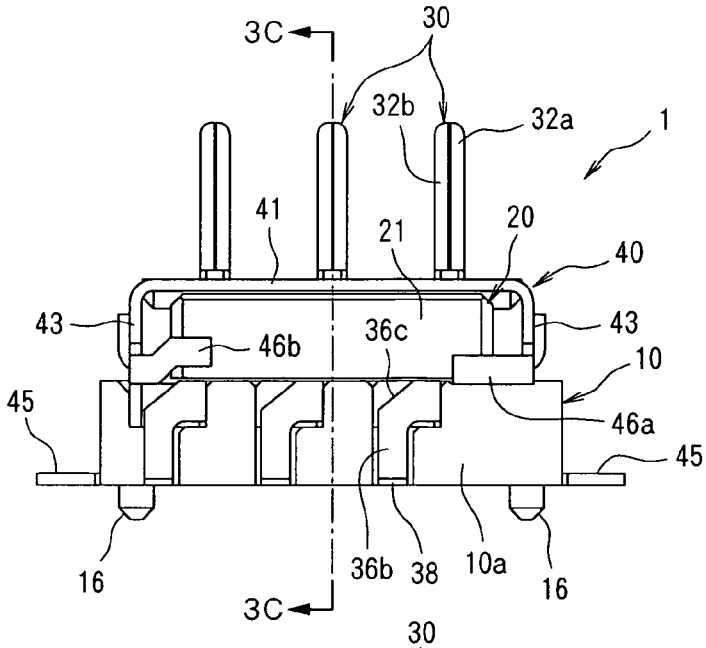
FIGS. 3A through 3C show the board attachment type electrical connector of FIG. 1, with FIG. 3A being a left-side view, FIG. 3B being a right-side view, and FIG. 3C being a sectional view along line 3C—3C in FIG. 3A.
Figure 3B:
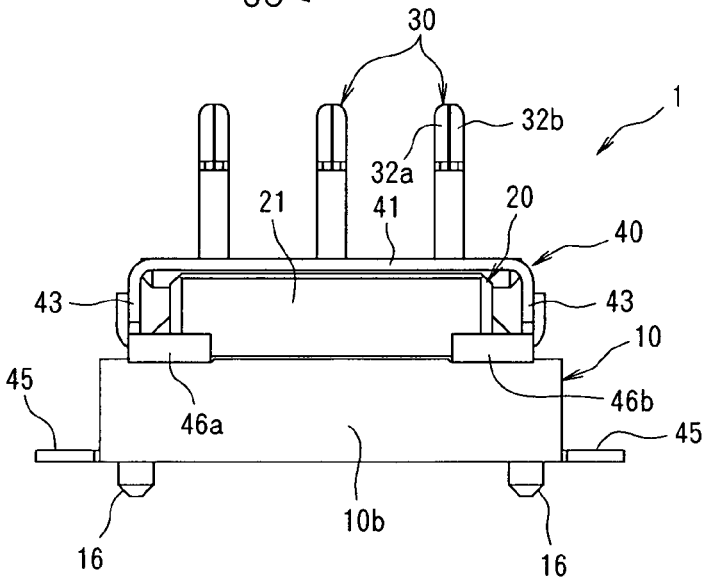
Figure 3C:
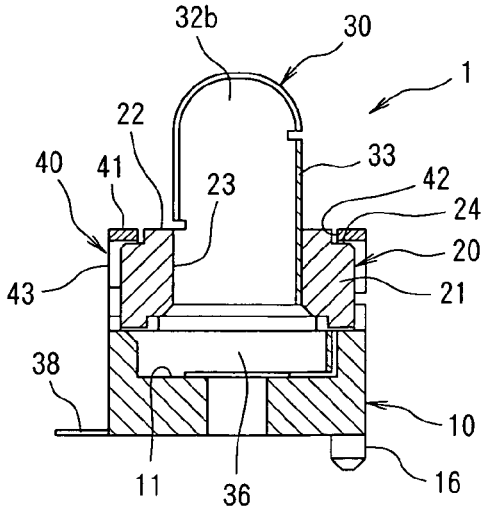

In addition, as is shown in FIGS. 1, 2A through 2C, 3A through 3C, the solder peg 40 has an opening 42 that is formed substantially in the central portion thereof so that the protruding part 22 of the second housing 20 can pass through this opening 42; this solder peg 40 comprises an upper plate 41 that covers the upper surface of the base stand part 21 of the second housing 20, and a pair of end walls 43 that cover the front- and rear-end surfaces of the second housing 20 by being bent along these front- and rear-end surfaces from either end portion of the upper plate 41 in the forward-rearward direction. The solder peg 40 is integrally formed by stamping and forming a metal plate. The legs 44 that are press-fitted into the press-fitted fastening holes 15 in the first housing 10 are formed on the lower edges of the respective end walls 43 in the central portion in the left-right direction so that these legs protrude downward. Pressed parts 47 that are pressed by a press-fitting jig for the solder peg 40 protrude from the upper portion of the respective end walls 43. The respective legs 44 are provided with fastening parts 45 that are fastened to the surface of the circuit board by being bent outward from the legs 44. Furthermore, a pair of left-right movement restricting parts 46*a* that are respectively bent rearward along the left- and right-side surfaces of the base stand part 21 of the second housing 20 are provided on the two edges (left and right edges) of the front-end wall 43. Likewise, a pair of left-right movement restricting parts 46*b* that are respectively bent forward along the left- and right-side surfaces of the base stand part 21 of the second housing 20 are provided on the two edges (left and right edges) of the rear-end wall 43. As is shown in FIGS. 1 and 3A, of the pair of left-right movement restricting parts 46*b*, the left-right movement restricting part 46*b* on the left side extends forward after extending upward at an inclination so as to avoid the connecting part 36*b* of the contact 30 on the rear. Excessive upward movement of the second housing 20 is restricted by the upper plate part 41 of the solder peg 40 covering the surface of the base stand part 21 of the second housing 20. Furthermore, excessive movement of the second housing 20 in the forward-rearward direction is restricted by the front- and rear-end walls 43 of the solder peg 40 covering the front- and rear-end surfaces of the second housing 20. Moreover, excessive movement of the second housing 20 in the left-right direction is restricted by the pair of left-right movement restricting parts 46*a* and pair of left-right movement restricting parts 46*b* of the solder peg 40 being positioned along the left- and right-side surfaces of the second housing 20.

The electrical connector 1 is mounted on the circuit board by connecting the board connecting parts 38 of the respective contacts 30 and the fastening parts 45 of the solder peg 40 by soldering to the circuit board. When the mating battery connector mates with the electrical connector I in a state in which the electrical connector 1 is mounted on the circuit board, the mating contacts contact the first and second contact plates 32*a* and 32*b* of the respective contacts 30. As a result, the mating battery connector and the circuit board are electrically connected.

In cases where an impact is applied in the direction perpendicular to the main surfaces of the first and second contact plates 32*a* and 32*b* (i.e., in the forward-rearward direction) in a state in which the two connectors mate, or in cases where positional deviation occurs in the direction perpendicular to the main surfaces of the first and second contact plates 32*a* and 32*b* in the process of mating of the two connectors, the first and second contact plates 32*a* and 32*b* and the base plates 31 move in this direction together with the second housing 20. The reason for this is as follows: as a result of the press-fitting of the first press-fitting parts 35 provided for the first extension parts 34 into the press-fitted holes 12*a*, and as a result of the second press-fitting parts 37 provided for the second extension parts 36 into the press-fitted holes 12*b*, the respective base plates 31 between the first extension parts 34 and second extension parts 36 are made movable with respect to the board connecting parts 38 that are held by the first housing 10 in the direction of alignment of the contacts 30 (i.e., perpendicular to the main surfaces of the base plates 31) by means of the elasticity of both of the folded bent parts 34*a* and 36*a*, and of the first extension parts 34 and second extension parts 36. Consequently, an impact in the direction perpendicular to the contact parts can be absorbed.

Meanwhile, since the width of the first extension parts 34 and second extension parts 36 in the vertical direction is greater than the width of the board connecting parts 38 in the forward-rearward direction, a relatively large current (current having the maximum of approximately 3 A) can be caused to flow through the contacts 30.

Furthermore, since the solder peg 40 that is made of metal and that restricts the movement of the second housing 20 by covering the upper surface, both left- and right-side surfaces, and both front- and rear-end surfaces of the base stand part 21 of the second housing 20 is attached to the first housing 10, it is possible to restrict the movement of the second housing 20 by the compact solder peg 40 having a high strength and made of metal such as brass or stainless steel to which plating that allows soldering is applied. Therefore, there is no need to install any movement restricting part between the first housing 10 and the second housing 20 to restrict the movement of the second housing 20, making it possible to achieve a size reduction of the electrical connector 1.

Next, a board attachment type electrical connector according to a second embodiment of the present invention will be described with reference to FIGS. 8, 9A through 9C, and 10A through 10C. In FIGS. 8, 9A through 9C, and 10A through 10C, parts that are the same as the parts shown in FIGS. 1, 2A through 2C, and 3A through 3C are indicated with the same symbols.

The board attachment type electrical connector (hereafter referred to simply as "electrical connector") 1 shown in FIGS. 8, 9A through 9C, and 10A through 10C is the same as the electrical connector 1 shown in FIGS. 1, 2A through 2C, and 3A through 3C in terms of the basic structure, the difference is in the structure of the metal solder peg.

Specifically, while the solder peg 40 in the electrical connector 1 shown in FIGS. 1, 2A through 2C, and 3A through 3C is formed as an integral unit, the solder pegs 40A and 40B in the electrical connector 1 shown in FIGS. 8, 9A through 9C, and 10A through 10C are formed as two units.

As is shown in FIGS. 8, 9A through 9C, 10A through 10C, the solder peg 40A on one end comprises an end wall 42*a* that covers the front-end surface of the second housing 20 along this front-end surface, and a pair of vertical movement restricting plates 41*a* that cover the upper surface of the base stand part 21 of the second housing 20 by being bent rearward from the upper edges of either end of the end wall 42*a* in the left-right direction. The solder peg 40A is formed by stamping and forming a metal plate. Furthermore, a leg 43*a* that is press-fitted into a press-fitted fastening hole (not shown in the figures) in the first housing 10 is formed on the lower edge of the end wall 42*a* in the central portion in the left-right direction so that this leg 43*a* protrudes downward. A fastening part 44*a* that is fastened to the circuit board by being bent outward from the leg 43*a* is provided on the leg 43*a*. Moreover, a pair of left-right movement restricting parts 45*a* that are bent rearward along the left- and right-side surfaces of the base stand part 21 of the second housing 20 are provided on the two edges (left and right edges) of the end wall 42*a*.

Figure 8:
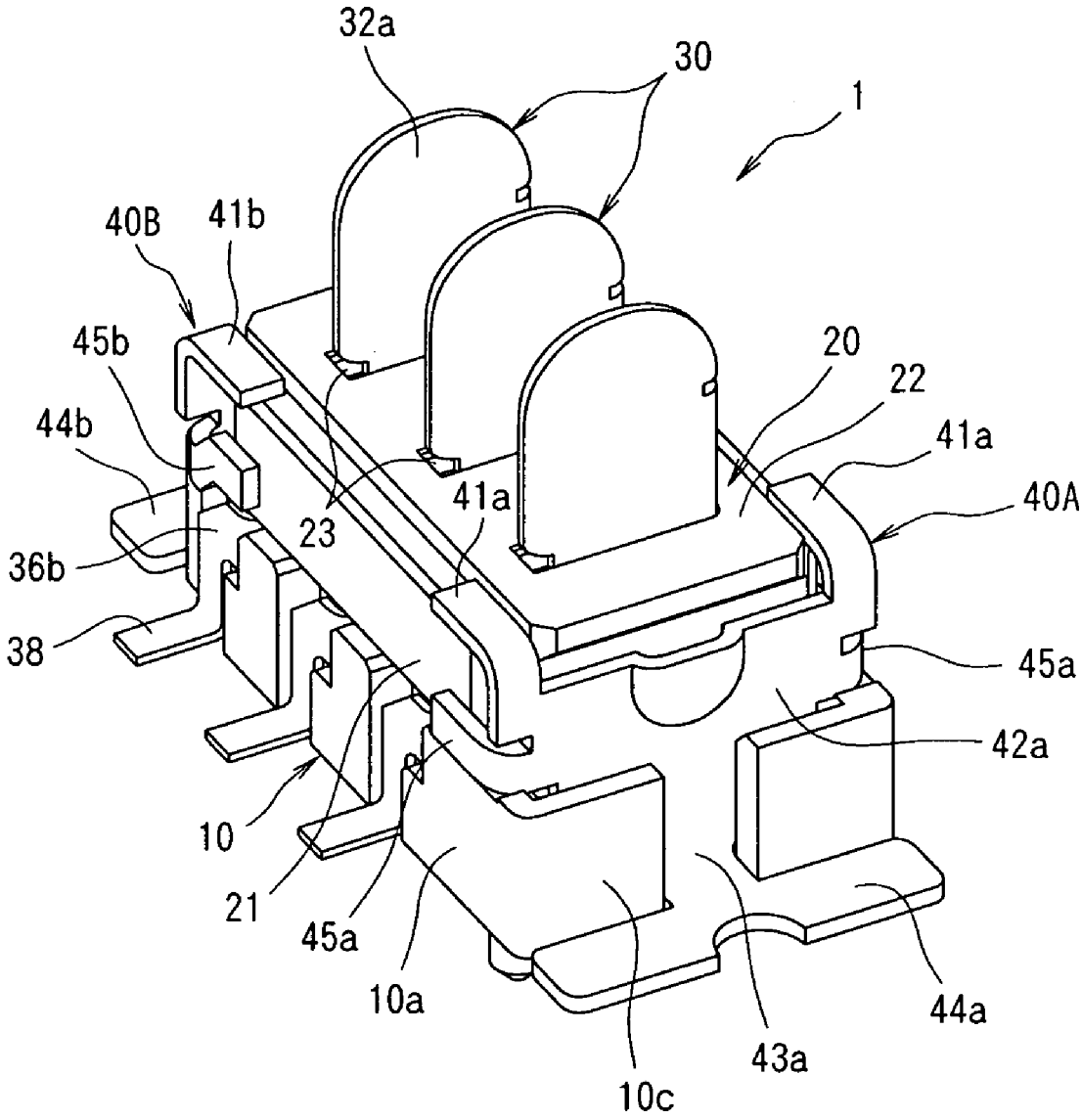
FIG. 8 is a perspective view of a board attachment type electrical connector according to another exemplary embodiment of the present invention.
Figure 9C:
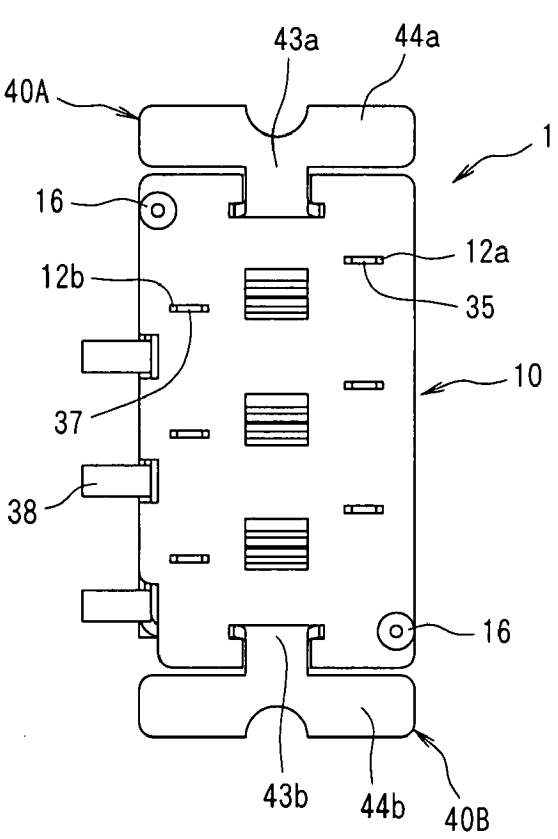
FIGS. 9A through 9C show the board attachment type electrical connector of FIG. 8, with FIG. 9A being a plan view, FIG. 9B being a front view, and FIG. 9C being a bottom view.
Figure 9B:
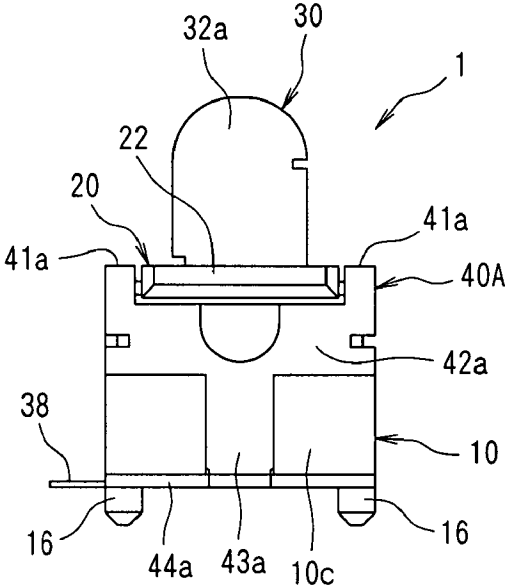
Figure 9A:
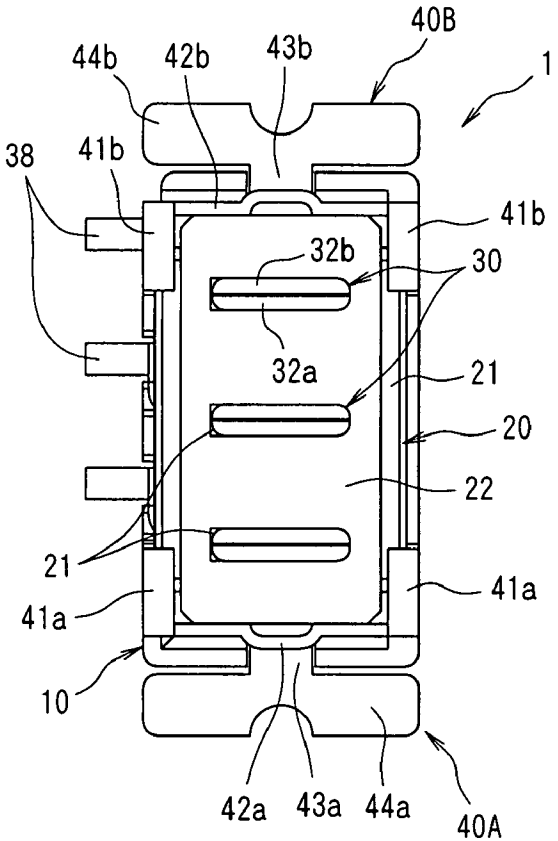
Figure 10A:
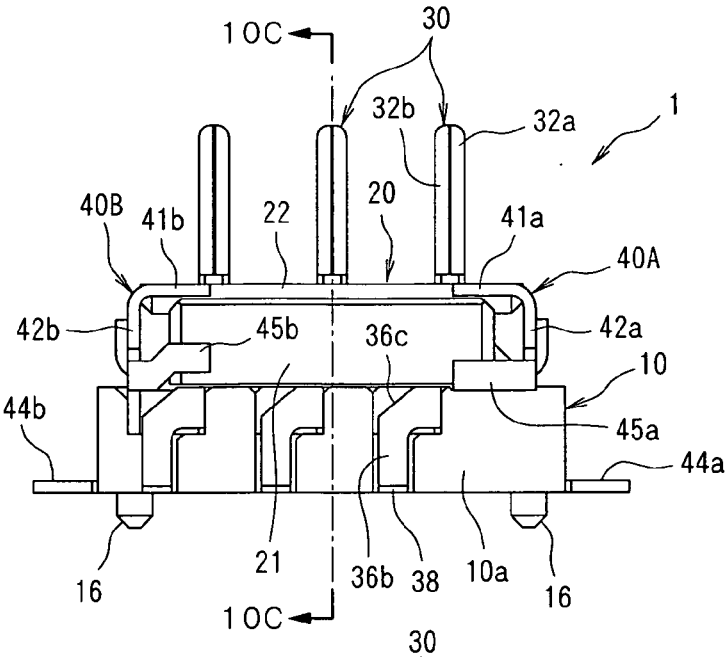
FIGS. 10A through 10C show the board attachment type electrical connector of FIG. 8, with FIG. 10A being a left-side view, FIG. 10B being a right-side view, and FIG. 10C being a sectional view along line 10C—10C in FIG. 10A.
Figure 10B:
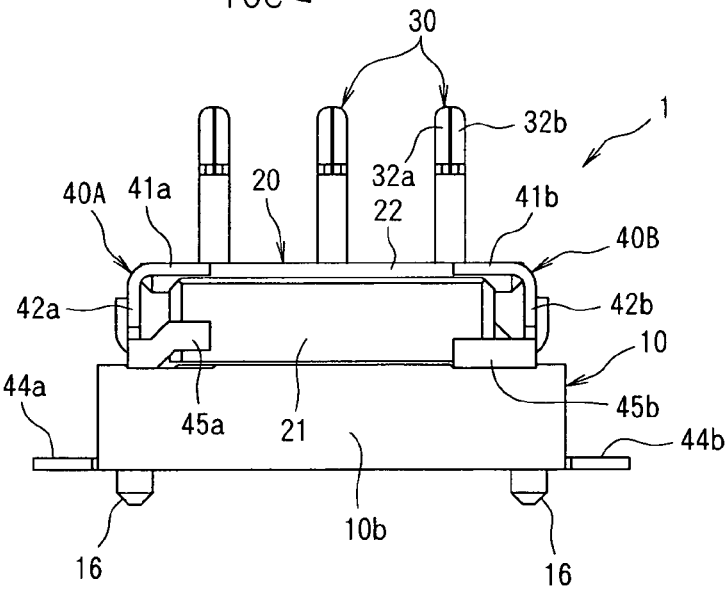
Figure 10C:
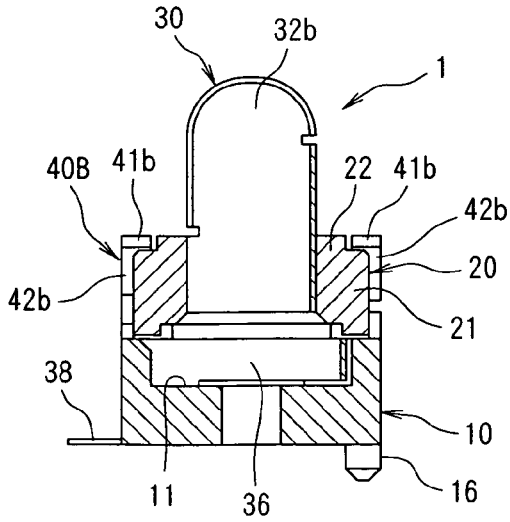
Figure 11:
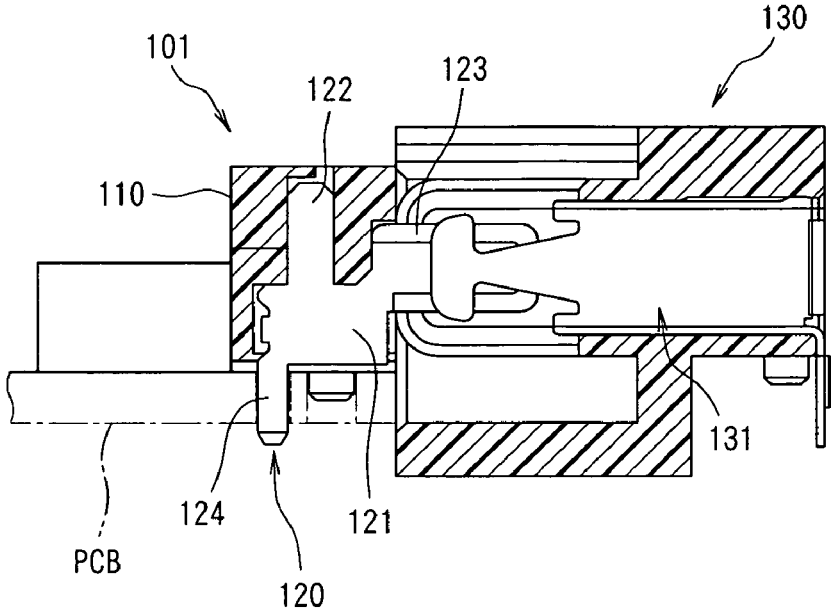
FIG. 11 is a sectional view of a conventional example of a board attachment type electrical connector.
Figure 12:
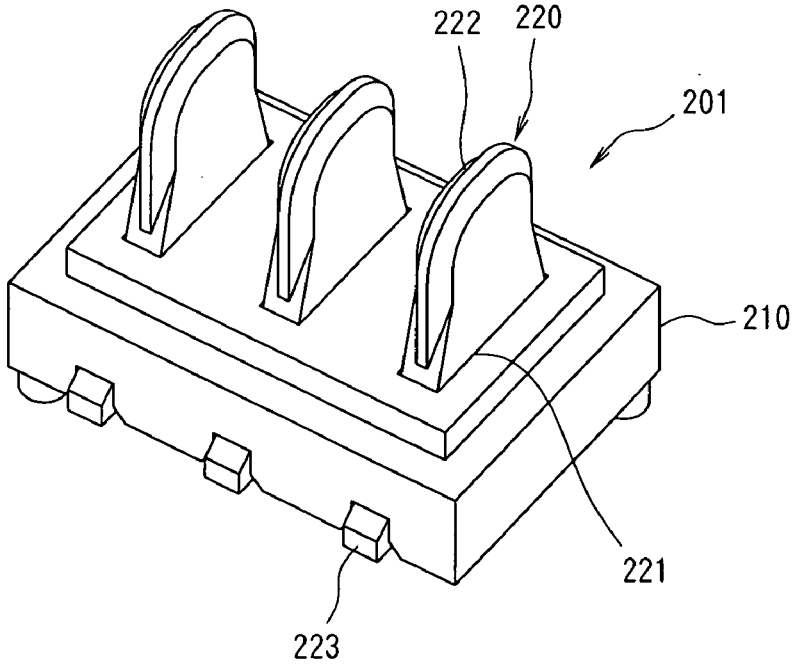
FIG. 12 is a perspective view of another conventional example of a board attachment type electrical connector.
Figure 13:
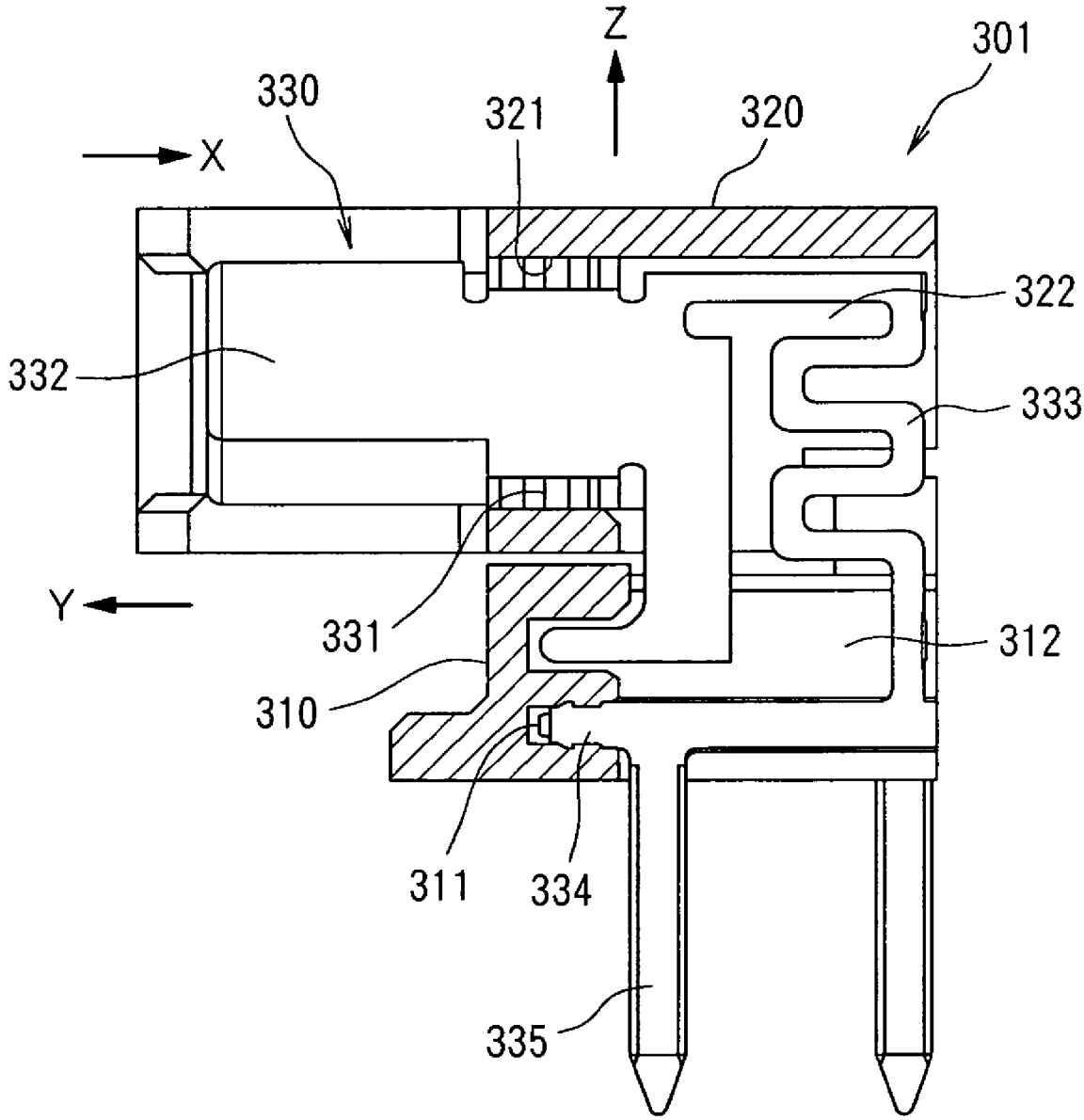
FIG. 13 is a sectional view of yet another conventional example of a board attachment type electrical connector.

Furthermore, the other solder peg 40B is formed with a substantially symmetrical shape with the first solder peg 40A as shown in FIGS. 8, 9A through 9C, 10A through 10C, and comprises an end wall 42*b* that covers the rear-end surface of the second housing 20 along this rear-end surface, and a pair of vertical movement restricting plates 41*b* that cover the upper surface of the base stand part 21 of the second housing 20 by being bent forward from the upper edges of either end of the end wall 42*b* in the left-right direction. The solder peg 40B is formed by stamping and forming a metal plate. Furthermore, a leg 43*b* that is press-fitted into a press-fitted fastening hole (not shown in the figures) in the first housing 10 is formed on the lower edge of the end wall 42*b* in the central portion in the left-right direction so that this leg 43*b* protrudes downward. A fastening part 44*b* that is fastened to the circuit board by being bent outward from the leg 43*b* is provided on the leg 43*b*. Moreover, a pair of left-right movement restricting parts 45*b* that are bent forward along the left- and right-side surfaces of the base stand part 21 of the second housing 20 are provided on the two edges (left and right edges) of the end wall 42*b*. As is shown in FIG. 8, of the pair of left-right movement restricting parts 45*b*, the left-right movement restricting part 45*b* on the left side extends forward after extending upward at an inclination so as to avoid the connecting part 36*b* of the contact 30 on the rear.

Furthermore, the upward movement of the second housing 20 is restricted by the respective vertical movement restricting plate parts 41*a* and 41*b* of the solder pegs 40A and 40B covering the surface of the base stand part 21 of the second housing 20. Moreover, the movement of the second housing 20 in the forward-rearward direction is restricted by the front- and rear-end wall parts 42*a* and 42*b* of the solder pegs 40A and 40B covering the front- and rear-end surfaces of the second housing 20. In addition, the movement of the second housing 20 in the left-right direction is restricted by the pair of left-right movement restricting parts 45*a* of the solder peg 40A and the pair of left-right movement restricting parts 45*b* of the solder peg 40B being positioned along the left- and right-side surfaces of the second housing 20.

By forming the solder pegs 40A and 40B as two units as in the present embodiment, the material removal at the time of stamping of the solder pegs is more favorable, compared to the formation of the solder peg as a single unit, so that the manufacturing cost can be reduced.

Moreover, the movement of the second housing 20 can be restricted by the two units of metal solder pegs 40A and 40B, so that there is no need to install any movement restricting part that restricts the movement of the second housing 20 between the first housing 10 and the second housing 20, thus making it possible to achieve a size reduction of the electrical connector 1.

Furthermore, in the present embodiment, in cases where an impact is applied in the direction perpendicular to the main surfaces of the first and second contact plates 32*a* and 32*b* (i.e., in the direction of alignment of the contacts 30) in a state in which the two connectors mate, or in cases where positional deviation occurs in the direction perpendicular to the main surfaces of the first and second contact plates 32*a* and 32*b* in the process of mating of the two connectors, the first and second contact plates 32*a* and 32*b* and the base plates 31 move in this direction together with the second housing 20. Accordingly, an impact in the direction perpendicular to the contact parts can be absorbed.

In addition, as in the first embodiment, since the width of the first extension parts (not shown in the figures) and second extension parts (not shown in the figures) in the vertical direction is greater than the width of the board connecting parts 38 in the forward-rearward direction, a relatively large current (current having the maximum of approximately 3 A) can be caused to flow through the contacts 30.

Embodiments of the present invention were described above. However, the present invention is not limited to these embodiments, and various alterations or modifications can be made.

For example, the "contact parts" are constructed from the base plate parts 31, first and second contact plates 32*a* and 32*b*, and folded bent parts 33; however, as long as the "contact parts" are held by the second housing 20 and contact the mating contacts, the "contact parts" are not limited to these constructions.

Furthermore, the first and second contact plates 32*a* and 32*b* are formed as male type parts that are accommodated by and make contact with the mating contacts; however, it would also be possible to construct these contact plates as female type parts that conversely accommodate the mating contacts.

Moreover, the board connecting parts 38 are provided on the respective connecting parts 36*b* provided for the second extension parts 36, but may also be provided for the first extension parts 34, or may also be provided for both the second extension parts 36 and first extension parts 34.

In addition, as long as the upper surface, the two side surfaces, and the two end surfaces are covered, the solder pegs 40, 40A and 40B are not limited to the examples depicted in the figures.

Furthermore, as long as a required current-carrying capacity can be ensured, the width of the first and second extension parts 34 and 36 in the vertical direction may be the same or smaller than the width of the board connecting parts 38 in the forward-rearward direction.

What is claimed is:

1. A board attachment type electrical connector comprising a first housing, a second housing located on the first housing movable with respect to the first housing, and a plurality of contacts, each contact having a contact part that is held by the second housing and that contacts a corresponding mating contact, a board connecting part that is held by the first housing and that is connected to a circuit board, and a flexible connecting part that allows the contact part to have free play with respect to the board connecting part, wherein the flexible connecting part has a first extension part that extends in a direction substantially parallel to the contact part after being bent from one side edge of the contact part, and a second extension part that extends in the opposite direction from the first extension part substantially parallel to the contact part after being bent from the other side edge of the contact part, and at least one of the first and second extension parts is connected to the board connecting part.

2. The board attachment type connector according to claim 1, wherein the width of the first extension parts and second extension parts is greater than the width of the board connecting part.

3. The board attachment type electrical connector according to claim 1, wherein a solder peg made of metal restricts the movement of the second housing by covering the upper surface, both side surfaces, and both end surfaces of the second housing is attached to the first housing.

4. The board attachment type electrical connector according to claim 3, wherein the solder peg is a single integral part.

5. The board attachment type electrical connector according to claim 3, wherein the solder peg comprises two parts disposed on opposite ends of the second housing, and each part extends at least partially over the upper surface, both side surfaces, and a respective end surface of the second housing.

* * * * *